US011624297B2

(12) United States Patent
Lee et al.

(10) Patent No.: US 11,624,297 B2
(45) Date of Patent: Apr. 11, 2023

(54) TURBINE EXHAUST UNIT SUPPORTING DEVICE, TURBINE INCLUDING SAME, AND GAS TURBINE INCLUDING SAME

(71) Applicant: DOOSAN ENERBILITY CO., LTD, Changwon (KR)

(72) Inventors: Young Do Lee, Changwon (KR); Young Chan Yang, Changwon (KR)

( * ) Notice: Subject to any disclaimer, the term of this patent is extended or adjusted under 35 U.S.C. 154(b) by 99 days.

(21) Appl. No.: 17/198,153

(22) Filed: Mar. 10, 2021

(65) Prior Publication Data

US 2021/0285340 A1 Sep. 16, 2021

(30) Foreign Application Priority Data

Mar. 13, 2020 (KR) ..... 10-2020-0031545

(51) Int. Cl.

| | |
|---|---|
| ***F01D 25/30*** | (2006.01) |
| ***F01D 25/28*** | (2006.01) |
| ***F01D 25/24*** | (2006.01) |
| *F01D 5/06* | (2006.01) |

(52) U.S. Cl.

CPC ..... *F01D 25/30* (2013.01); *F01D 25/24* (2013.01); *F01D 5/066* (2013.01); *F01D 25/28* (2013.01); *F05D 2230/642* (2013.01); *F05D 2240/90* (2013.01)

(58) Field of Classification Search

CPC ..... F01D 25/24; F01D 25/28; F02C 7/20

See application file for complete search history.

(56) References Cited

U.S. PATENT DOCUMENTS

| | | | | |
|---|---|---|---|---|
| 3,079,127 | A * | 2/1963 | Rowlett | F01D 17/143 415/48 |
| 4,411,134 | A * | 10/1983 | Moir | F01D 25/24 60/796 |
| 2006/0225427 | A1* | 10/2006 | Bainachi | F02K 1/12 60/771 |
| 2007/0031247 | A1* | 2/2007 | Spitzer | F01D 25/30 415/182.1 |
| 2008/0251633 | A1 | 10/2008 | Journade | |
| 2010/0226770 | A1* | 9/2010 | Frick | F01D 25/24 415/214.1 |
| 2012/0275922 | A1* | 11/2012 | Praisner | F01D 9/041 416/223 A |
| 2014/0047850 | A1* | 2/2014 | McMahon | F02C 7/20 60/797 |

(Continued)

FOREIGN PATENT DOCUMENTS

CN 106907243 B 8/2019

*Primary Examiner* — Ted Kim

(74) *Attorney, Agent, or Firm* — Harvest IP Law, LLP

(57) ABSTRACT

A turbine exhaust unit supporting device that supports a turbine exhaust unit is provided. The turbine exhaust unit supporting device installed at a rear side of a turbine casing to support a turbine exhaust unit through which exhaust gas passing through a turbine is discharged, the supporting device includes a casing supporting block unit installed on an outer circumferential surface of the turbine casing, an exhaust unit supporting block unit spaced apart from the casing supporting block unit and installed on an outer circumferential surface of the turbine exhaust unit, and a rotary coupler including a first end rotatably coupled to the casing supporting block unit and a second end rotatably coupled to the exhaust unit supporting block unit.

14 Claims, 6 Drawing Sheets

(56) References Cited

U.S. PATENT DOCUMENTS

| | | | | |
|---|---|---|---|---|
| 2016/0146101 | A1* | 5/2016 | Lee | F01D 5/066<br>415/68 |
| 2018/0298769 | A1* | 10/2018 | Jeong | F01D 9/041 |
| 2018/0320555 | A1 | 11/2018 | Heo | |
| 2019/0085730 | A1 | 3/2019 | Bae | |

* cited by examiner

TURBINE EXHAUST UNIT SUPPORTING DEVICE, TURBINE INCLUDING SAME, AND GAS TURBINE INCLUDING SAME

CROSS-REFERENCE TO RELATED APPLICATION

This application claims priority to Korean Patent Application No. 10-2020-0031545, filed on Mar. 13, 2020, the disclosure of which is incorporated herein by reference in its entirety.

BACKGROUND

1. Field

Apparatuses and methods consistent with exemplary embodiments relate to a turbine exhaust unit supporting device, a turbine including the same supporting device, and a gas turbine including the same turbine and, more particularly, to a turbine exhaust unit supporting device having an improved structure to prevent thermal deformation of a turbine exhaust unit, a turbine including the same supporting device, and a gas turbine that employs the same supporting structure.

2. Description of the Related Art

A turbine is a machine that generates rotating force from an impulse force or a reaction force using a flow of compressive fluid such as gas. Turbines are classified into steam turbines using steam and gas turbines using high-temperature combustion gas.

A gas turbine includes a compressor section, a combustor section, and a turbine section. The compressor section includes a plurality of compressor vanes and a plurality of compressor blades alternately arranged in a compressor casing with an air inlet through which air is introduced.

The combustor section supplies fuel to the compressed air generated by the compressor section and ignites a fuel-air mixture with a burner to produce high-temperature and high-pressure combustion gas.

The turbine section includes a plurality of turbine vanes and a plurality of turbine blades alternately arranged in a turbine casing. A rotor extends through centers of the compressor section, the combustor section, the turbine section, and an exhaust chamber.

The rotor is rotatably supported by bearings at both ends thereof. A plurality of disks are fixed to the rotor, and the plurality of blades are coupled to corresponding disks, respectively. A driving shaft of a generator is coupled to an end of the rotor that is adjacent to the exhaust chamber.

This gas turbine does not include a reciprocating mechanism such as a piston which is usually provided in a typical four-stroke engine. That is, the gas turbine has no mutual frictional parts such as a piston-cylinder part, thereby consuming an extremely small amount of lubricating oil and reducing the operational movement range, resulting in high speed operability.

A brief description of the operation of a gas turbine is as follows. Air compressed by the compressor is mixed with fuel, the fuel-air mixture is burned to produce high-temperature combustion gas, and the high-temperature combustion gas is ejected toward the turbine. The ejected combustion gas generates a rotating force by passing the turbine vanes and the turbine blades, thereby generating the rotor.

As described above, the high-temperature and high-pressure combustion gas is discharged outside through an exhaust unit after rotating the rotor. In this case, the exhaust unit undergoes thermal deformation due to the hot exhaust gas. Therefore, a structure that supports the exhaust unit is damaged by thermal stress. This also has a problem that the location of the exhaust unit is changed.

SUMMARY

Aspects of one or more exemplary embodiments provide a turbine exhaust unit supporting device that prevents damage to a turbine exhaust unit by adaptively supporting the turbine exhaust unit while coping with thermal deformation of the turbine exhaust unit to minimize thermal stress generated in the turbine exhaust unit.

Additional aspects will be set forth in part in the description which follows and, in part, will become apparent from the description, or may be learned by practice of the exemplary embodiments.

According to an aspect of an exemplary embodiment, there is provided a turbine exhaust unit supporting device installed at a rear side of a turbine casing to support a turbine exhaust unit through which exhaust gas passing through a turbine is discharged, the turbine exhaust unit supporting device including: a casing supporting block unit installed on an external surface of the turbine casing; an exhaust unit supporting block unit spaced apart from the casing supporting block and installed on an external surface of the turbine exhaust unit; and a rotary coupler including a first end rotatably coupled to the casing supporting block unit and a second end rotatably coupled to the exhaust unit supporting block unit.

The casing supporting block unit may include a casing supporting block fixed along an external circumference of the turbine casing and a pair of casing holding protrusions protruding from one surface of the casing supporting block.

The exhaust unit supporting block unit may further include an exhaust unit supporting block fixed along an external circumference of the turbine exhaust unit, and an exhaust unit fixing piece protruding toward the turbine casing from one side surface of the exhaust unit supporting block.

A first connection hole extending through the casing fixing piece may be formed, and a second connection hole extending through the exhaust unit fixing piece may be formed. The rotary coupler may include a connection rod provided with a first bolt hole and a second bolt hole communicating with the first connection hole and the second connection hole, respectively, a first connection pin inserted into the first connection hole and the first bolt hole, and a second connection pin inserted into the second connection hole and the second bolt hole.

The device may further include a first pin fixing nut and a second pin fixing nut respectively disposed at a first end of the first connection pin and a first end of the second connection pin and configured to respectively fix the first connection pin and the second connection pin.

The exhaust unit supporting block may include a length fixing block elongated along a longitudinal direction of the turbine exhaust unit and fixed to the turbine exhaust unit at a first end thereof, and an outer periphery fixing block extending in a circumferential direction of the turbine exhaust unit from a second end of the length fixing block.

The exhaust unit fixing piece may include an outer periphery fixing piece fixed to the outer periphery fixing block at a first end thereof and configured to protrude toward the turbine exhaust unit, a length fixing piece protruding in a longitudinal direction of the turbine exhaust unit from a second end of the outer periphery fixing piece, and a connection piece formed at a first end of the length fixing piece and connected to the connection rod.

The length fixing piece may include a triangular horizontal supporting plate coupled to the outer periphery piece at a first end thereof and a vertical supporting plate perpendicularly coupled to an exhaust side of the horizontal supporting plate.

The supporting device may further include a stopper formed on a lower surface of the connection rod to limit a rotation angle of the connection rod.

One side of the stopper is coupled to the connection rod and the other side of the stopper is coupled to a lower surface of the vertical supporting plate.

According to an aspect of another exemplary embodiment, there is provided a turbine configured to generate a driving force to generate electric power by passing a combustion gas supplied from a combustor, the turbine including: a plurality of turbine rotors including a plurality of turbine disks and a plurality of turbine blades coupled to an outer surface of each of the plurality of turbine disks; a plurality of turbine vanes disposed between the plurality of blades; a turbine casing configured to accommodate the turbine rotors and the turbine vanes guiding a flow of the combustion gas, the plurality of turbine rotors being arranged in multiple stages and mounted on a circumferential surface of a tie rod and being rotated by the combustion gas supplied from the combustor during operation of a gas turbine; a turbine exhaust unit coupled to one side of the turbine casing and configured to discharge the combustion gas passing through the plurality of turbine rotors; and a turbine exhaust unit supporting device including a casing supporting block unit installed on a circumferential surface of the turbine casing, an exhaust unit supporting block unit spaced apart from the casing supporting block unit and installed on an outer circumferential surface of the turbine exhaust unit, and a rotary coupler having a first end rotatably coupled to the casing supporting block unit and a second end rotatably coupled to the exhaust unit supporting block unit.

According to an aspect of another exemplary embodiment, there is provided a gas turbine including: a compressor configured to compress air externally introduced; a combustor configured to mix fuel with the compressed air supplied from the compressor and to combust air and fuel mixture to produce combustion gas; and a turbine configured to generate power by the combustion gas supplied from the combustor and configured to include: a turbine rotor including a plurality of turbine disks and a plurality of turbine blades coupled to an outer surface of each of the plurality of turbine disks; a plurality of turbine vanes disposed between the plurality of blades; a turbine casing configured to accommodate the turbine rotor mounted in multiple stages on an outer circumferential surface of a tie rod and rotated by the combustion gas supplied from the combustor during operation of the gas turbine and the turbine vanes guiding a flow of the combustion gas; a turbine exhaust unit coupled to one side of the turbine casing and configured to discharge the combustion gas passing through the turbine rotor; a turbine exhaust unit supporting device including: a casing supporting block unit installed on an outer circumferential surface of the turbine casing; an exhaust unit supporting block unit spaced apart from the casing supporting block unit and installed on an outer circumferential surface of the turbine exhaust unit; and a rotary coupler having a first end rotatably coupled to the casing supporting block unit and a second end rotatably coupled to the exhaust unit supporting block unit.

According to one or more exemplary embodiments, the turbine exhaust unit supporting device can support a turbine exhaust unit while coping with thermal deformation of the turbine exhaust unit, thereby preventing damage to the turbine exhaust unit caused by the thermal deformation of the turbine exhaust unit during operation of a turbine.

BRIEF DESCRIPTION OF THE DRAWINGS

The above and other aspects will become more apparent from the following description of the exemplary embodiments with reference to the accompanying drawings, in which.

DETAILED DESCRIPTION OF THE DISCLOSURE

Figure 1:
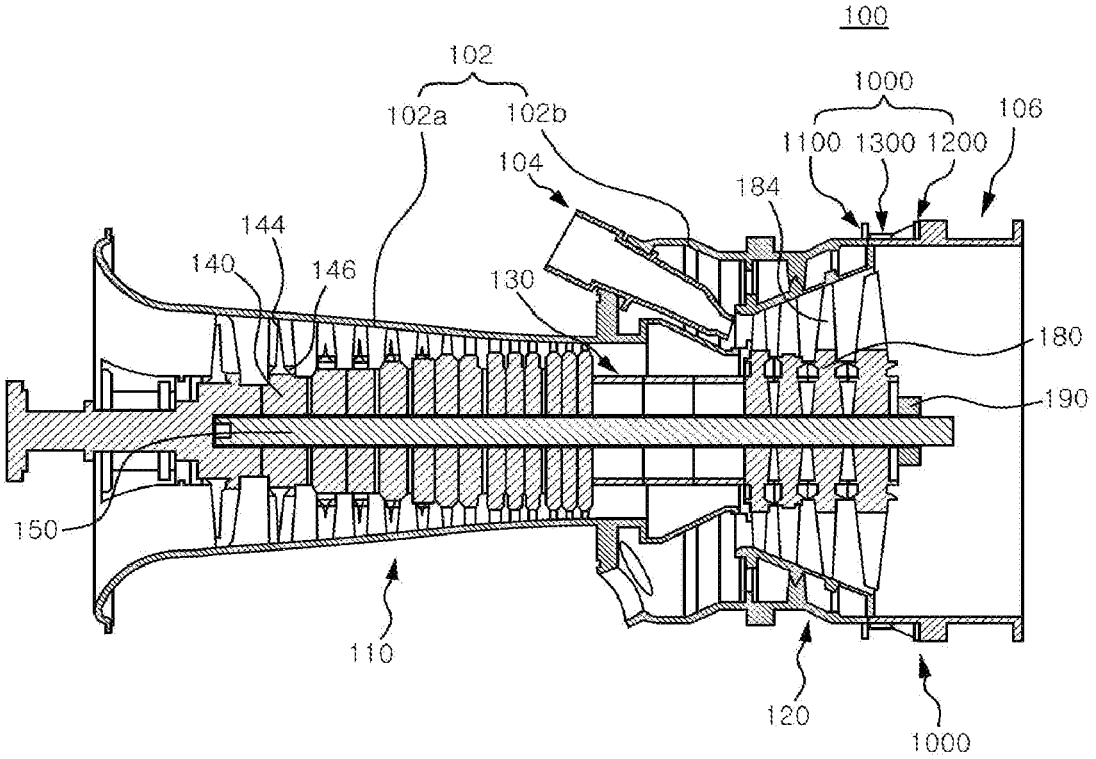
FIG. 1 is a cross-sectional view schematically illustrating a structure of a gas turbine according to an exemplary embodiment.

Various modifications and various embodiments will be described in detail with reference to the accompanying drawings so that those skilled in the art can easily carry out the disclosure. It should be understood, however, that the various embodiments are not for limiting the scope of the disclosure to the specific embodiment, but they should be interpreted to include all modifications, equivalents, and alternatives of the embodiments included within the spirit and scope disclosed herein.

Hereinafter, exemplary embodiments will be described in detail with reference to the accompanying drawings. In order to clearly illustrate the disclosure in the drawings, some of the elements that are not essential to the complete understanding of the disclosure may be omitted, and like reference numerals refer to like elements throughout the specification.

Figure 2:
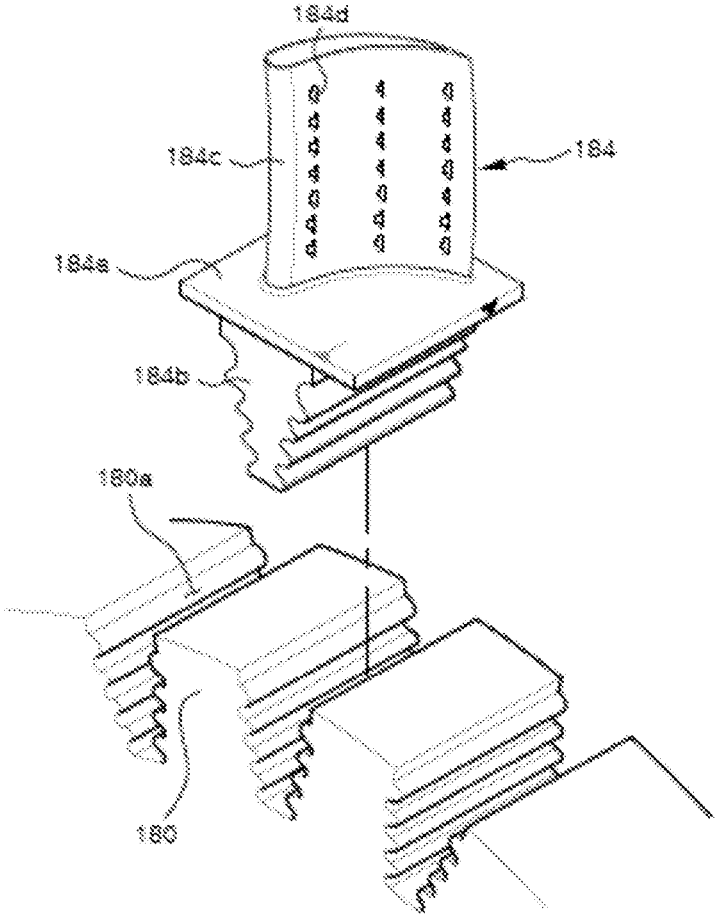
FIG. 2 is an exploded perspective view illustrating a turbine rotor disk of FIG. 1.

FIG. 1 illustrates an example of a gas turbine 100 according to an exemplary embodiment. FIG. 2 is an exploded perspective view illustrating a turbine rotor disk of FIG. 1.

Referring to FIG. 1, the gas turbine 100 includes a casing 102 including a compressor casing 102*a* and a turbine casing 102*b*. A diffuser that is a turbine exhaust unit 106 from which combustion gas passing through a turbine is discharged is provided at a rear side of the casing 102. A combustor 104 that burns a mixture of fuel and compressed air is disposed at a front side of the diffuser.

Based on a flow direction of air, a compressor 110 is disposed at an upstream side of the casing 102, and a turbine 120 is disposed at a downstream side of the casing 102. In addition, a torque tube 130 serving as a torque transmission member for transmitting torque generated by the turbine 120 to the compressor 110 is installed between the compressor 110 and the turbine 120.

The compressor 110 includes a plurality of compressor rotor disks 140, each of which is fastened by a tie rod 150 to prevent axial separation in an axial direction.

For example, the compressor rotor disks 140 are arranged in the axial direction in such a way that the tie rod 150 that forms a rotating shaft passes through central portions of the compressor rotor disks 140. Here, adjacent compressor rotor disks 140 are arranged such that facing surfaces thereof are in tight contact with each other by the tie rod 150. The adjacent compressor rotor disks 140 cannot rotate relative to each other because of this arrangement.

A plurality of compressor blades 144 are radially coupled to an outer circumferential surface of each of the compressor rotor disks 140. Each of the compressor blades 144 has a root member 146 that is coupled to the compressor rotor disk 410.

A plurality of compressor vanes are fixedly arranged between each of the compressor rotor disks 140. While the compressor rotor disks 1120 rotate along with a rotation of the tie rod 1600, the compressor vanes fixed to the casing do not rotate. The compressor vanes guide the flow of the compressed air moved from front-stage compressor blades of the compressor rotor disk to rear-stage compressor blades of the compressor rotor disk.

A coupling scheme of the root member 146 is classified into a tangential type and an axial type. This may be selected according to the structure of a gas turbine to be used. The root member has a dovetail shape or a fir-tree shape. Alternatively, the compressor blades can be coupled to the compressor rotor disks by using other types of coupling members, such as a key or a bolt.

The tie rod 150 is arranged passing through central portions of the compressor rotor disks 140 and the turbine rotor disks 180. One end of the tie rod 150 is fastened to the most upstream compressor rotor disk, and the other end thereof is engaged with a fixing nut 190.

It is understood that the shape of the tie rod 150 is not limited to example illustrated in FIG. 1, and may be changed or vary according to one or more other exemplary embodiments. For example, a single tie rod may be disposed passing through the centers of all of the rotor disks, a plurality of tie rods may be arranged in a circumferential direction, or a combination thereof is also possible.

Also, a vane functioning as a guide vane may be installed at the rear stage of the diffuser of the compressor to adjust an actual flow angle of fluid entering into the combustor and increase the pressure of the fluid. This vane is referred to as a deswirler.

The combustor 104 mixes introduced compressed air with fuel, burns the air-fuel mixture to produce high-temperature and high-pressure combustion gas, and increases, through an isobaric combustion process, the temperature of the combustion gas to a temperature at which the combustor and the turbine can endure.

A plurality of combustors constituting the combustor 104 may be positioned in a combustor casing in a form of a cell. Each combustor includes a burner having fuel injection nozzles, a combustor liner defining a combustion chamber, and a transition piece serving as a connector between the combustor and the turbine.

The combustor liner defines the combustion chamber in which the fuel injected through the fuel injection nozzle and the compressed air supplied from the compressor are mixed and burned. The combustor liner may include a flame tube providing the combustion chamber in which the fuel-air mixture is burned, and a flow sleeve that surrounds the flame tube to define an annular space enclosing the flame tube. A fuel nozzle assembly is coupled to a front end (i.e., upstream end) of the combustor liner, and a spark igniter plug is coupled to a sidewall of the combustor liner.

The transition piece is coupled to a rear end (i.e., downstream end) of the combustor liner to deliver the combustion gas, produced in the combustion chamber after the flame is started by the spark igniter plug, to the turbine. In order to prevent the transition piece from being damaged by the heat of the high-temperature and high-pressure combustion gas, an outer wall of the transition piece is cooled by compressed air supplied from the compressor.

To this end, the transition piece is provided with cooling holes through which the compressed air is blown into the transition piece. The compressed air first cools the inside of the main body of the transition piece and then flows toward the combustor liner to cool the combustor.

The compressed air that has cooled the transition piece flows into an annular space of the combustor liner. A portion of the compressed air is externally introduced into the annular space through cooling holes formed in the flow sleeve and this air collides against an outer surface of the combustor liner.

The high-temperature and high-pressure combustion gas ejected from the combustor 104 is supplied to the turbine 120. The supplied high-temperature and high-pressure combustion gas expands and applies impingement or a reaction force to the turbine blades to generate a torque. A portion of the torque is transmitted to the compressor 110 via the torque tube 130, and the remaining portion which is the excessive torque is used to drive an electric generator or the like.

The turbine 120 basically has a structure similar to that of the compressor 110. That is, the turbine 120 includes a turbine rotor, turbine vanes, and a turbine casing.

The turbine rotor is rotated by the combustion gas supplied from the combustor during operation of the gas turbine. The turbine rotor includes a plurality of turbine blades 184 and a plurality of turbine rotor disks 180 that are arranged in multiple stages and put on a tie rod. The turbine rotor disks 180 are similarly structured to the compressor rotor disks 140. The plurality of turbine blades 184 are radially coupled to an outer circumferential surface of each turbine rotor disk 180. Each turbine blades 184 may be coupled to a corresponding turbine rotor disk 180 in a dovetail coupling manner. In addition, a plurality of turbine vanes fixed to an inner circumferential surface of the turbine casing are provided between the turbine blades 184 of the adjacent turbine rotor disks 180 to guide a flow direction of the combustion gas passing through the turbine blades 184.

The turbine casing accommodates the turbine rotor disks and the turbine vanes.

Referring to FIG. 2, the turbine rotor disk 180 has a substantial disk shape and includes a plurality of coupling slots 180*a* formed in an outer circumferential surface thereof. Each of the coupling slots 180*a* has a fir-tree-shaped corrugated surface.

The turbine blade 184 is coupled to the coupling slot 180*a* and includes a platform member 184*a* having a planar shape at an approximately central portion thereof. The platform member 184*a* has a side surface which comes into contact with a side surface of the platform member 184*a* of an adjacent turbine blade to maintain an interval between the adjacent turbine blades 184. A root member 184*b* is provided under a lower surface of the platform member 184*a*. The root members 184*b* has an axial-type structure so that the root member 184*b* is inserted into the coupling slot 180*a* along an axial direction of the turbine rotor disk 180.

The root member 184*b* has a substantially fir-tree-shaped corrugated portion corresponding to the fir-tree-shaped corrugated surface formed in the coupling slot 180*a*. It is understood that the coupling structure of the root member 1141 is not limited to a fir-tree shape, and may be formed to have a dovetail shape.

A blade member 184*c* is formed on an upper surface of the platform member 184*a* to have an optimized airfoil shape according to specifications of the gas turbine. The blade member 184*c* has a leading edge which is disposed at an upstream side with respect to the flow direction of the combustion gas and a trailing edge which is disposed at a downstream side.

The turbine blade comes into direct contact with high-temperature and high-pressure combustion gas. Because the combustion gas has a high temperature reaching 1700° C., a cooling means for cooling the turbine blades is required. To this end, the turbine section includes a cooling passage through which a portion of the compressed air is drawn out from some portions of the compressor and is supplied to the turbine blades.

The cooling passage may extend outside the turbine casing (i.e., an external passage), extend through the interior of the turbine rotor disk (i.e., an internal passage), or both of the external passage and the internal passage may be used. A plurality of film cooling holes 184*d* are formed in a surface of the blade member. The film cooling holes 184*d* communicate with cooling fluid channels formed in the blade member 184*c* to supply cold air to the surface of the blade member 184*c*.

Figure 3:
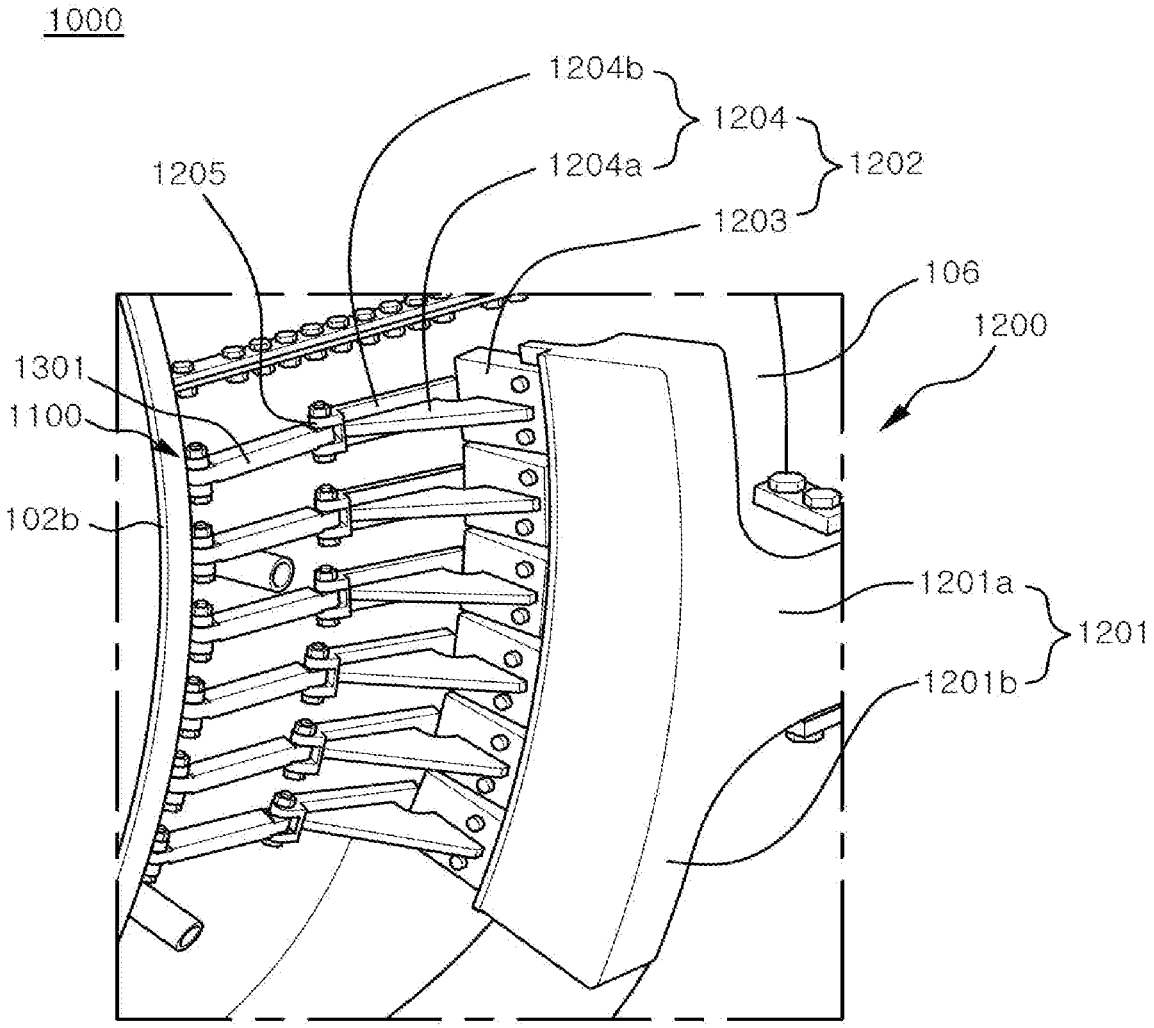
FIG. 3 is a perspective view of a turbine exhaust unit supporting device according to a first exemplary embodiment.
Figure 4:
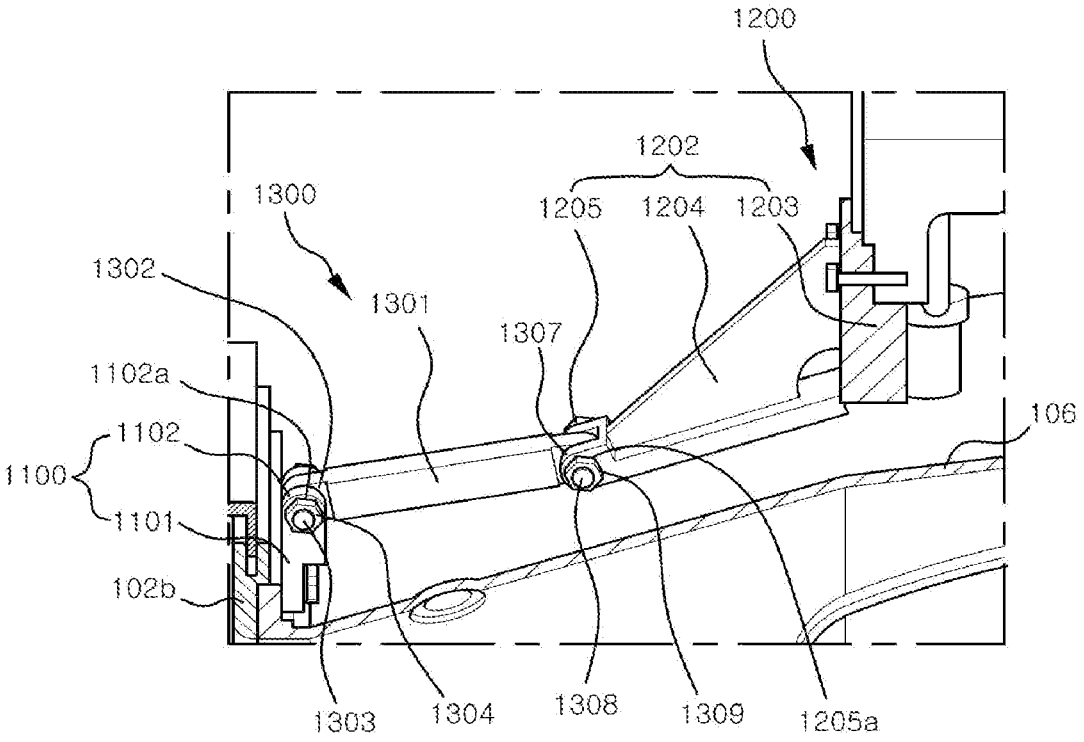
FIG. 4 is a configuration diagram illustrating a coupling structure of a casing supporting block unit, an exhaust unit supporting block unit, and a rotary coupler, according to the first exemplary embodiment.

FIG. 3 is a perspective view of a turbine exhaust unit supporting device according to a first exemplary embodiment, and FIG. 4 is a configuration diagram illustrating a coupling structure of a casing supporting block unit, an exhaust unit supporting block unit, and a rotary coupler, according to the first exemplary embodiment. A turbine exhaust unit supporting device 1000 is installed between the turbine casing and the diffuser, i.e., a turbine exhaust unit 106 through which combustion gas is discharged outside to fix the turbine exhaust unit 106.

Referring to FIGS. 3 and 4, the turbine exhaust unit supporting device 1000 includes a casing supporting block unit 1100, an exhaust unit supporting block unit 1200, and a rotary coupler 1300.

The turbine exhaust unit 106 is installed at a rear end of the turbine casing and discharges exhaust gas passing through the turbine. The turbine exhaust unit 106 is implemented with the diffuser to reduce the speed of discharge of the exhaust gas.

The turbine exhaust unit supporting device 1000 is disposed between the turbine casing 102*b* and the turbine exhaust unit 106. That is, one end of the turbine exhaust unit supporting device 1000 is coupled to the turbine casing 102*b* and the other end thereof is coupled to the turbine exhaust unit 106 so that the turbine casing 102*b* and the turbine exhaust unit 106 are connected to each other.

The casing supporting block unit 1100 installed on the turbine casing 102*b* includes a plurality of casing supporting blocks 1101 and a plurality of casing fixing pieces 1102.

The plurality of casing supporting blocks 1101 are fixedly arranged along the outer periphery of the turbine casing 102*b*. Two casing fixing pieces 1102 protrude from each side of each casing supporting blocks 1101. The two casing fixing pieces 1102 are spaced apart from each other. One end of a connection rod 1301 is inserted and coupled between the two casing fixing pieces 1102. A first connection hole 1102*a* is installed to extend through the casing fixing piece 1102.

The exhaust unit supporting block unit 1200 is installed on the outer periphery of the turbine exhaust unit 106. The exhaust unit supporting block unit 1200 is spaced apart from the casing supporting block unit 1100, and one end of the exhaust unit supporting block unit 1200 is fixed to the turbine exhaust unit 106.

The exhaust unit supporting block unit 1200 includes a plurality of exhaust unit supporting blocks 1201 and a plurality of exhaust unit fixing pieces 1202. The plurality of exhaust unit supporting blocks 1201 are fixedly arranged along the outer periphery of the turbine exhaust unit 106.

The exhaust unit supporting block 1201 includes a length fixing block 1201*a* and an outer periphery fixing block 1201*b*. One end of the length fixing block 1201*a* is fixed to the turbine exhaust unit 106 and is formed to be elongated along the longitudinal direction of the turbine exhaust unit 106. The exhaust unit supporting block 1201 has an overall "T" shape.

Each exhaust unit fixing piece 1202 protruding toward the turbine casing is formed on one side surface of the exhaust unit supporting block 1201. A second connection hole 1205*a* is installed to extend through the exhaust unit fixing piece 1202.

The exhaust unit fixing piece 1202 includes an outer periphery fixing piece 1203, a length fixing piece 1204, and a connection piece 1205. One end of the outer periphery fixing piece 1203 is fixed to the outer periphery fixing block 1201*b* and is formed to protrude toward the turbine exhaust unit 106. The length fixing piece 1204 protrudes from the other end of the outer periphery fixing piece 1203 and extends in the longitudinal direction of the turbine exhaust unit 106. The length fixing piece 1204 includes a horizontal support plate 1204*a* having a triangular panel shape and a vertical support plate 1204*b*. One end of the horizontal support plate 1204*a* is coupled to the outer periphery fixing piece 1203, and the other end thereof is vertically coupled to the vertical support plate 1204*b*. The horizontal support plate 1204*a* is formed in a triangular panel shape to have high strength.

The connection piece 1205 is formed at one end of the length fixing piece 1204 and has the second connection hole 1205*a* in a center thereof. The connection piece 1205 is coupled to the connection rod 1301.

The rotary coupler 1300 is formed between the casing supporting block unit 1100 and the exhaust unit supporting block unit 1200, and both ends of the rotary coupler 1300 are coupled to the casing supporting block unit 1100 and the exhaust unit supporting block unit 1200, respectively.

The rotary coupler 1300 includes a connection rod 1301, a first connection pin 1303 and a second connection pin 1308. First and second ends of the connection rod 1301 are provided with first and second bolt holes 1302 and 1307, respectively. The first bolt hole 1302 is formed to communicate with the first connection hole 1102*a*, and the second bolt hole 1307 is formed to communicate with the second connection hole 1205*a*.

The first connection pin 1303 is inserted into the first bolt hole 1302 and the first connection hole 1102*a* so that the connection rod 1301 and the casing fixing piece 1102 are rotatably connected to each other.

A first pin fixing nut 1304 is engaged with a first end of the first connection pin 1303 to prevent the first connection pin 1303 from being removed from the first bolt hole 1302 and the first connection hole 1102*a*. The first pin fixing nut 1304 and the first connection pin 1303 are screwed together.

The second connection pin 1308 is inserted into the second bolt hole 1307 and the second connection hole 1205*a* so that the connection rod 1301 and the exhaust unit fixing piece 1202 are rotatably connected to each other.

A second pin fixing nut 1309 is engaged with a first end of the second connection pin 1308 to prevent the second connection pin 1308 from being removed from the second bolt hole 1307 and the second connection hole 1205*a*. The second pin fixing nut 1309 and the second connection pin 1308 are screwed together.

Here, when the hot exhaust gas is discharged through the turbine exhaust unit, if the exhaust unit is thermally deformed by the heat of hot exhaust gas, the turbine exhaust unit may be displaced in a radial direction of the turbine casing by the rotation of the connection rod. Therefore, the supporting device 1000 minimizes thermal stress generated in the turbine exhaust unit to prevent damage to the turbine exhaust unit.

In addition, the turbine exhaust unit supporting device can prevent the turbine exhaust unit from being removed from the turbine casing by maintaining a constant position in the axial direction of the turbine exhaust unit.

Figure 5:
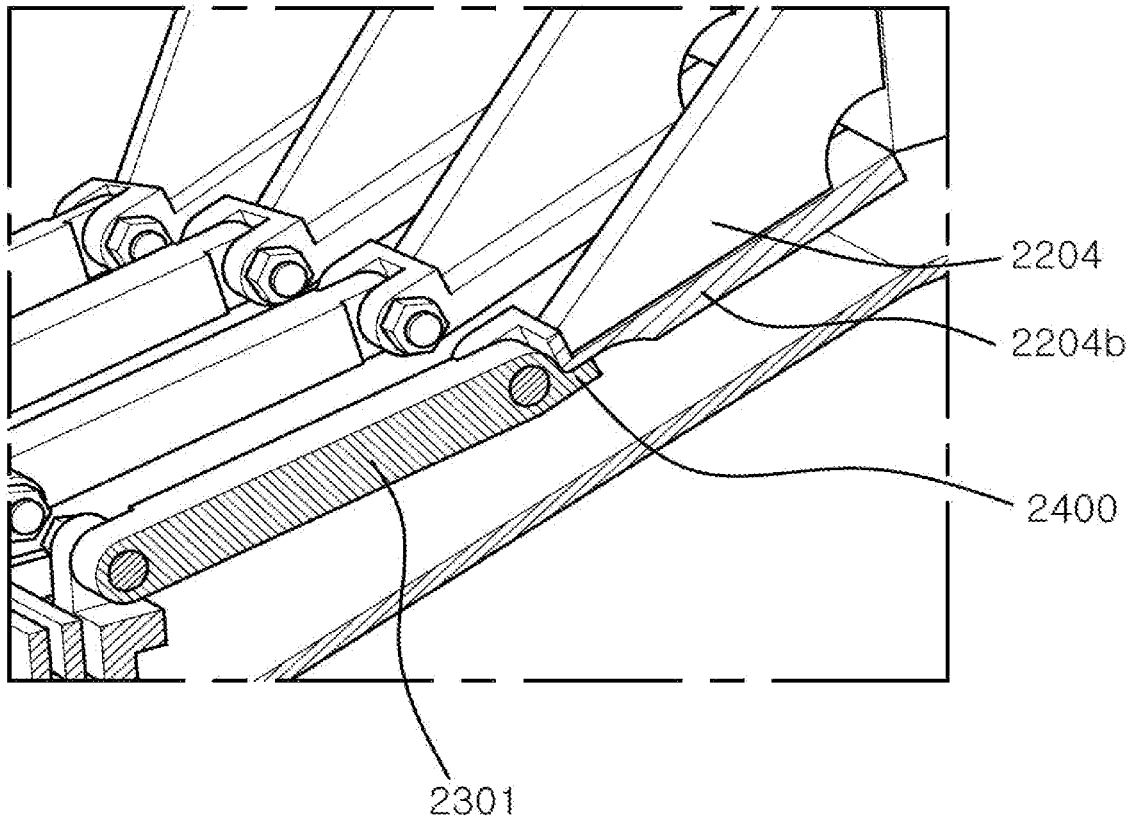
FIG. 5 is a perspective view of a turbine exhaust unit supporting device according to a second exemplary embodiment.
Figure 6:
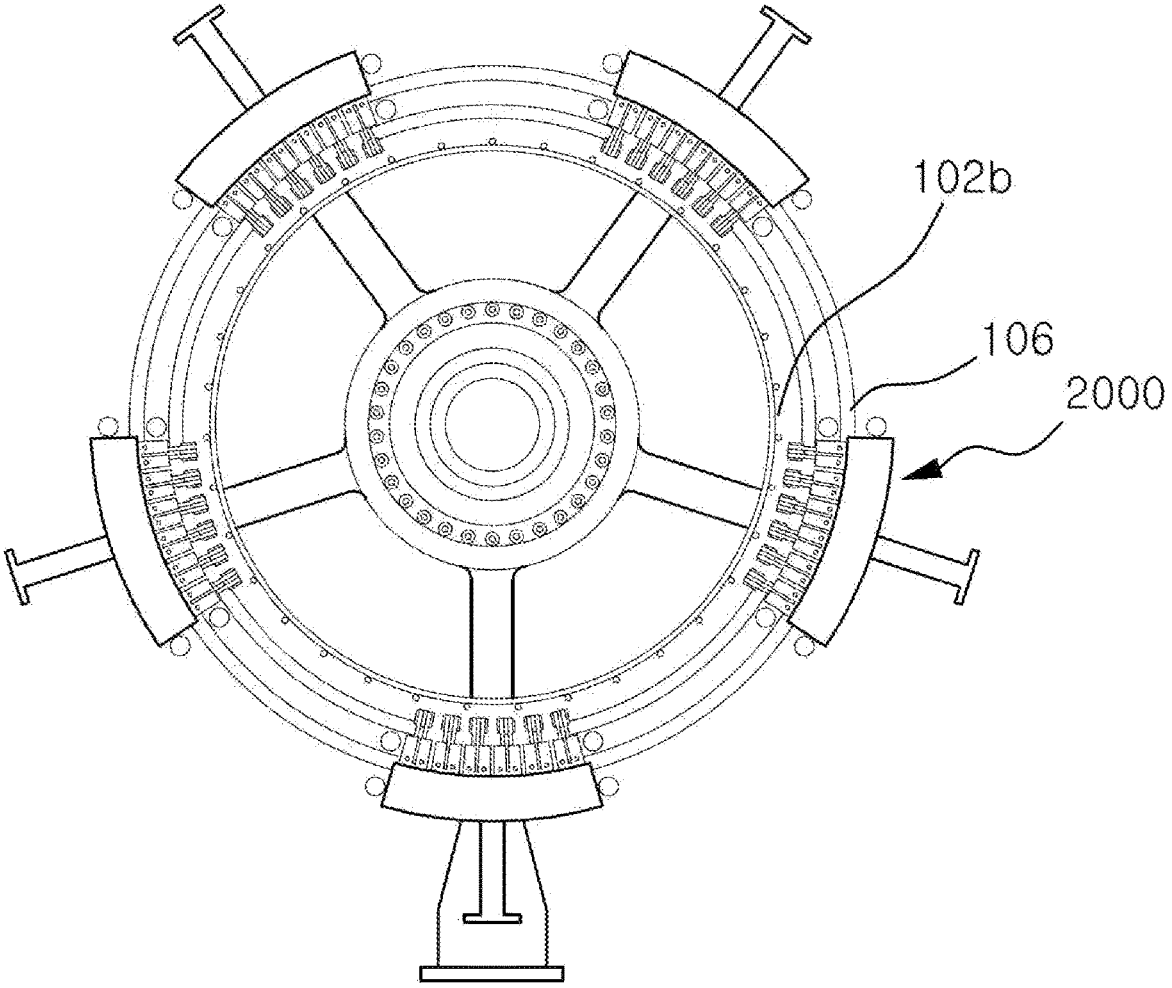
FIG. 6 is a front elevation illustrating a turbine to which the second exemplary embodiment is applicable.

FIG. 5 is a perspective view of a turbine exhaust unit supporting device according to a second exemplary embodiment, and FIG. 6 is a front view of a turbine to which the second exemplary embodiment is applicable.

Referring to FIGS. 5 and 6, a turbine exhaust unit supporting device 2000 includes a casing supporting block unit, an exhaust unit supporting block unit, a rotary coupler, and a stopper 2400.

The casing supporting block unit, the exhaust unit supporting block unit, and the rotary coupler of the turbine exhaust unit supporting device according to the second exemplary embodiment illustrated in FIG. 5 have the same construction as those of the turbine exhaust unit supporting device according to the first exemplary embodiment illustrated in FIGS. 3 and 4. Therefore, those components will not be described and only the stopper 2400 will be described in detail below.

The stopper 2400 is formed to protrude from a lower surface of one end of the connection rod 2301. One side of the stopper 2400 is coupled to the connection rod 2301, and the other side is in contact with the lower surface of a vertical supporting plate 2204*b* of the length fixing piece 2204.

One end of the stopper 2400 contacts the lower surface of the vertical supporting plate 2204*b* so that the connecting rod 2301 moves only in a direction in which the radius of the turbine exhaust unit 106 increases. Accordingly, even though thermal expansion and contraction are repeated, the center of the turbine exhaust unit 106 with respect to the turbine casing 102*b* can be maintained.

While one or more exemplary embodiments have been described with reference to the accompanying drawings, it is to be understood by those skilled in the art that various modifications and changes in form and details may be made therein without departing from the spirit and scope as defined by the appended claims. Accordingly, the description of the exemplary embodiments should be construed in a descriptive sense only and not to limit the scope of the claims, and many alternatives, modifications, and variations will be apparent to those skilled in the art.

What is claimed is:

1. A turbine exhaust unit supporting device installed at a rear side of a turbine casing to support a turbine exhaust unit through which exhaust gas passing through a turbine is discharged, the supporting device comprising:

a casing supporting block unit installed on an outer circumferential surface of the turbine casing;

an exhaust unit supporting block unit spaced apart from the casing supporting block unit and installed on an outer circumferential surface of the turbine exhaust unit, wherein the exhaust unit supporting block unit comprises:

an exhaust unit supporting block fixed along the outer circumferential surface of the turbine exhaust unit, wherein the exhaust unit supporting block generally having a T shape when viewed from outside of the turbine comprises:

a length fixing block elongated along a longitudinal direction of the turbine exhaust unit and fixed to the turbine exhaust unit at a first end thereof, and an outer periphery fixing block extending in a circumferential direction of the turbine exhaust unit from a second end of the length fixing block, wherein a radially outer surface of the length fixing block flushes with a radially outer surface of the outer periphery fixing block, and an exhaust unit fixing piece comprising an outer periphery fixing piece fixed to both a radially inner side and an upstream side of the outer periphery fixing block and protruding toward the turbine casing, a length fixing piece protruding in the longitudinal direction of the turbine exhaust unit from an upstream side of the outer periphery fixing piece, and a connection piece formed at a first end of the length fixing piece; and a rotary coupler including a first end rotatably coupled to the casing supporting block unit and a second end rotatably coupled to the exhaust unit supporting block unit.

2. The supporting device according to claim 1, wherein the casing supporting block unit comprises a casing supporting block fixed along an external circumference of the turbine casing and a pair of casing fixing pieces spaced apart from each other and protruding from one side surface of the casing supporting block.

3. The supporting device according to claim 2, wherein a first connection hole extending through the pair of casing fixing pieces is formed, a second connection hole extending through the exhaust unit fixing piece is formed, and the rotary coupler includes a connection rod provided with a first bolt hole and a second bolt hole communicating with the first connection hole and the second connection hole, respectively, a first connection pin inserted into the first connection hole and the first bolt hole, and a second connection pin inserted into the second connection hole and the second bolt hole.

4. The supporting device according to claim 3, further comprising a first pin fixing nut and a second pin fixing nut respectively disposed at a first end of the first connection pin and a first end of the second connection pin and configured to respectively fix the first connection pin and the second connection pin.

5. The supporting device according to claim 4, wherein the connection piece formed at the first end of the length fixing piece is connected to the connection rod.

6. The supporting device according to claim 5, wherein the length fixing piece comprises a triangular horizontal supporting plate coupled to the outer periphery fixing piece at a first end thereof and a vertical supporting plate perpendicularly coupled to an exhaust side of the horizontal supporting plate.

7. The supporting device according to claim 6, further comprising a stopper formed on a lower surface of the connection rod to limit a rotation angle of the connection rod.

8. The supporting device according to claim 7, wherein one side of the stopper is coupled to the connection rod, and another side of the stopper is in contact with a lower surface of the vertical supporting plate.

9. A turbine configured to generate a driving force to generate electric power by passing a combustion gas supplied from a combustor, the turbine comprising:

a plurality of turbine rotors comprising a plurality of turbine disks and a plurality of turbine blades coupled to an outer surface of each of the plurality of turbine disks;

a plurality of turbine vanes disposed between the plurality of turbine blades;

a turbine casing configured to accommodate the turbine rotors and the turbine vanes guiding a flow of the combustion gas, the plurality of turbine rotors being arranged in multiple stages and mounted on a circumferential surface of a tie rod and being rotated by the combustion gas supplied from the combustor during operation of a gas turbine;

a turbine exhaust unit coupled to one side of the turbine casing and configured to discharge the combustion gas passing through the plurality of turbine rotors; and a turbine exhaust unit supporting device including a casing supporting block unit installed on an outer circumferential surface of the turbine casing, an exhaust unit supporting block unit spaced apart from the casing supporting block unit and installed on an outer circumferential surface of the turbine exhaust unit, wherein the exhaust unit supporting block unit comprises:

an exhaust unit supporting block fixed along the outer circumferential surface of the turbine exhaust unit, wherein the exhaust unit supporting block generally having a T shape when viewed from outside of the turbine comprises:

a length fixing block elongated along a longitudinal direction of the turbine exhaust unit and fixed to the turbine exhaust unit at a first end thereof, and an outer periphery fixing block extending in a circumferential direction of the turbine exhaust unit from a second end of the length fixing block, wherein a radially outer surface of the length fixing block flushes with a radially outer surface of the outer periphery fixing block; and an exhaust unit fixing piece comprising an outer periphery fixing piece fixed to both a radially inner side and an upstream side of the outer periphery fixing block and protruding toward the turbine casing, a length fixing piece protruding in the longitudinal direction of the turbine exhaust unit from an upstream side of the outer periphery fixing piece, and a connection piece formed at a first end of the length fixing piece, and a rotary coupler having a first end rotatably coupled to the casing supporting block unit and a second end rotatably coupled to the exhaust unit supporting block unit.

10. The turbine according to claim 9, wherein the casing supporting block unit comprises a casing supporting block fixed along an external circumference of the turbine casing and a pair of casing fixing pieces spaced apart from each other and protruding from one side surface of the casing supporting block.

11. The turbine according to claim 10, wherein first connection hole extending through the pair of casing fixing pieces is formed, a second connection hole extending through the exhaust unit fixing piece is formed, and the rotary coupler includes a connection rod provided with a first bolt hole and a second bolt hole communicating with the first connection hole and the second connection hole, respectively, a first connection pin inserted into the first connection hole and the first bolt hole, and a second connection pin inserted into the second connection hole and the second bolt hole.

12. A gas turbine comprising:

a compressor configured to compress air externally introduced;

a combustor configured to mix fuel with the compressed air supplied from the compressor and to combust air and fuel mixture to produce combustion gas; and a turbine configured to generate power by the combustion gas supplied from the combustor and configured to include:

a turbine rotor including a plurality of turbine disks and a plurality of turbine blades coupled to an outer surface of each of the plurality of turbine disks;

a plurality of turbine vanes disposed between the plurality of blades;

a turbine casing configured to accommodate the turbine rotor mounted in multiple stages on an outer circumferential surface of a tie rod and rotated by the combustion gas supplied from the combustor during operation of the gas turbine and the turbine vanes guiding a flow of the combustion gas;

a turbine exhaust unit coupled to one side of the turbine casing and configured to discharge the combustion gas passing through the turbine rotor; and a turbine exhaust unit supporting device including a casing supporting block unit installed on an outer circumferential surface of the turbine casing, an exhaust unit supporting block unit spaced apart from the casing supporting block unit and installed on an outer circumferential surface of the turbine exhaust unit, wherein the exhaust unit supporting block unit comprises:

an exhaust unit supporting block fixed along the outer circumferential surface of the turbine exhaust unit, wherein the exhaust unit supporting block generally having a T shape when viewed from outside of the turbine comprises:

a length fixing block elongated along a longitudinal direction of the turbine exhaust unit and fixed to the turbine exhaust unit at a first end thereof, and an outer periphery fixing block extending in a circumferential direction of the turbine exhaust unit from a second end of the length fixing block, wherein a radially outer surface of the length fixing block flushes with a radially outer surface of the outer periphery fixing block; and an exhaust unit fixing piece comprising an outer periphery fixing piece fixed to both a radially inner side and an upstream side of the outer periphery fixing block and protruding toward the turbine casing, a length fixing piece protruding in the longitudinal direction of the turbine exhaust unit from an upstream side of the outer periphery fixing piece, and a connection piece formed at a first end of the length fixing piece, and a rotary coupler having a first end rotatably coupled to the casing supporting block unit and a second end rotatably coupled to the exhaust unit supporting block unit.

13. The gas turbine according to claim 12, wherein the casing supporting block unit comprises a casing supporting block fixed along an external circumference of the turbine casing and a pair of casing fixing pieces spaced apart from each other and protruding from one side surface of the casing supporting block.

14. The gas turbine according to claim 13, wherein a first connection hole extending through the pair of casing fixing pieces is formed, a second connection hole extending through the exhaust unit fixing piece is formed, and the rotary coupler includes a connection rod provided with a first bolt hole and a second bolt hole communicating with the first connection hole and the second connection hole, respectively, a first connection pin inserted into the first connection hole and the first bolt hole, and a second connection pin inserted into the second connection hole and the second bolt hole.

* * * * *